US009314066B1

(12) United States Patent
Troconis et al.

(10) Patent No.: US 9,314,066 B1
(45) Date of Patent: Apr. 19, 2016

(54) WEARABLE WATERPROOF SHOE COVER

(71) Applicants: Daniela Troconis, South Miami, FL (US); Herbert King, South Miami, FL (US)

(72) Inventors: Daniela Troconis, South Miami, FL (US); Herbert King, South Miami, FL (US)

( * ) Notice: Subject to any disclaimer, the term of this patent is extended or adjusted under 35 U.S.C. 154(b) by 455 days.

(21) Appl. No.: 14/033,411

(22) Filed: Sep. 20, 2013

(51) Int. Cl.
*A43B 3/24* (2006.01)
*A43B 3/16* (2006.01)

(52) U.S. Cl.
CPC .. *A43B 3/16* (2013.01); *A43B 3/248* (2013.01)

(58) Field of Classification Search
CPC ..... A43B 3/16; A43B 3/163; A43B 3/24; A43B 3/248
USPC ..... 36/1, 136
See application file for complete search history.

(56) References Cited

U.S. PATENT DOCUMENTS

| | | | | |
|---|---|---|---|---|
| 2,799,951 | A | 7/1957 | Rogers | |
| 4,817,306 | A * | 4/1989 | Bayer | A43B 3/0031 2/247 |
| 5,642,573 | A * | 7/1997 | Brown | A41D 17/00 36/132 |
| 6,457,266 | B1 * | 10/2002 | Hsiao | A43B 3/00 206/216 |
| 6,715,220 | B1 * | 4/2004 | Isenberg | A43B 1/0036 36/136 |
| 2005/0246921 | A1 | 11/2005 | Baek | |
| 2013/0199058 | A1 * | 8/2013 | Fuerst | A43B 13/223 36/103 |
| 2014/0262658 | A1 * | 9/2014 | Wegener | A45C 3/12 190/109 |

* cited by examiner

*Primary Examiner* — Ted Kavanaugh
(74) *Attorney, Agent, or Firm* — Williams Intellectual Property; Benjamin F. Williams

(57) ABSTRACT

A wearable waterproof shoe cover that includes an impermeable elastomeric sheath adapted to fit over and envelope footwear to protect said footwear from fluids when walking through wet or muddy terrain, said sheath including a zippered pocket disposed thereon into which pocket the sheath involutes in a compact and folded situation for storage and portability.

5 Claims, 4 Drawing Sheets

WEARABLE WATERPROOF SHOE COVER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of shoe covers are known in the prior art. However, what is needed is a wearable waterproof shoe cover that includes an impermeable elastomeric sheath adapted to fit over and envelope footwear to protect said footwear from fluids when walking through wet or muddy terrain, said sheath including a zippered pocket into which pocket the sheath involutes in a compact and folded situation for storage and portability.

FIELD OF THE INVENTION

The present invention relates to a wearable waterproof shoe cover, and more particularly, to a wearable waterproof shoe cover that includes an impermeable elastomeric sheath adapted to fit over and envelope footwear to protect said footwear from fluids when walking through wet or muddy terrain, said sheath including a zippered pocket into which pocket the sheath involutes in a compact and folded situation for storage and portability.

SUMMARY OF THE INVENTION

The general purpose of the wearable waterproof shoe cover, described subsequently in greater detail, is to provide a wearable waterproof shoe cover which has many novel features that result in a wearable waterproof shoe cover which is not anticipated, rendered obvious, suggested, or even implied by prior art, either alone or in combination thereof.

The present wearable waterproof shoe cover has been devised to enable wearing of an impermeable, elastomeric sheath over extant footwear to provide a waterproof envelope whereby a user may walk through fluids, such as water and mud, while maintaining said extant footwear clean and dry. After traversing wet or muddy ground, a user may expediently remove the present wearable waterproof shoe cover for storage in a reversible zippered pocket disposed upon the sheath.

The present wearable waterproof shoe cover, therefore, includes an impermeable, elastomeric sheath that includes an open top, a foot portion, and an ankle portion. The elastomeric sheath is fittable around a shoe worn by a wearer when a zipper, disposed posteriorly upon the ankle portion of the sheath, is unzipped. After placement of the foot interior to the sheath, the zipper may be zipped closed to conform the sheath tightly around the foot and shoe of the wearer.

A drawstring is disposed within the sheath proximal the open end, said drawstring including a pair of ends disposed exteriorly through an aperture disposed upon the ankle portion above the foot portion. A wearer may tighten the drawstring to conform the open top tightly around the leg proximal the ankle and secure the sheath in position. The term drawstring, as used herein, is taken to include an elastomeric band disposed at the open top to conformably fit the open top around the leg of a wearer absent the need of pulling the pair of ends, as case may be, in an alternate embodiment. To assist in maintaining tracvite engagement around the leg of a wearer, a padded section may be included proximal the open top on an interior surface of the leg portion.

A sole is disposed upon the foot portion of the sheath for traction with a ground surface. The sole is configured to be pliable with a grip surface, for increased traction upon the ground, and for foldable storage within a zippered pocket, disposed upon the ankle portion of the sheath, as will be subsequently described.

The zippered pocket is disposed interiorly within the sheath upon the ankle portion of the sheath. The zippered pocket may be unzipped, and the sheath then involuted into the pocket for storage when moved to a folded position. An elastic mesh fabric liner is disposed interiorly upon the sheath and encloses the sheath when disposed in the zippered pocket, The mesh fabric liner enables breathability of the sheath when disposed in the folded position.

Thus has been broadly outlined the more important features of the present wearable waterproof shoe cover so that the detailed description thereof that follows may be better understood and in order that the present contribution to the art may be better appreciated.

Objects of the present wearable waterproof shoe cover, along with various novel features that characterize the invention are particularly pointed out in the claims forming a part of this disclosure. For better understanding of the wearable waterproof shoe cover, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
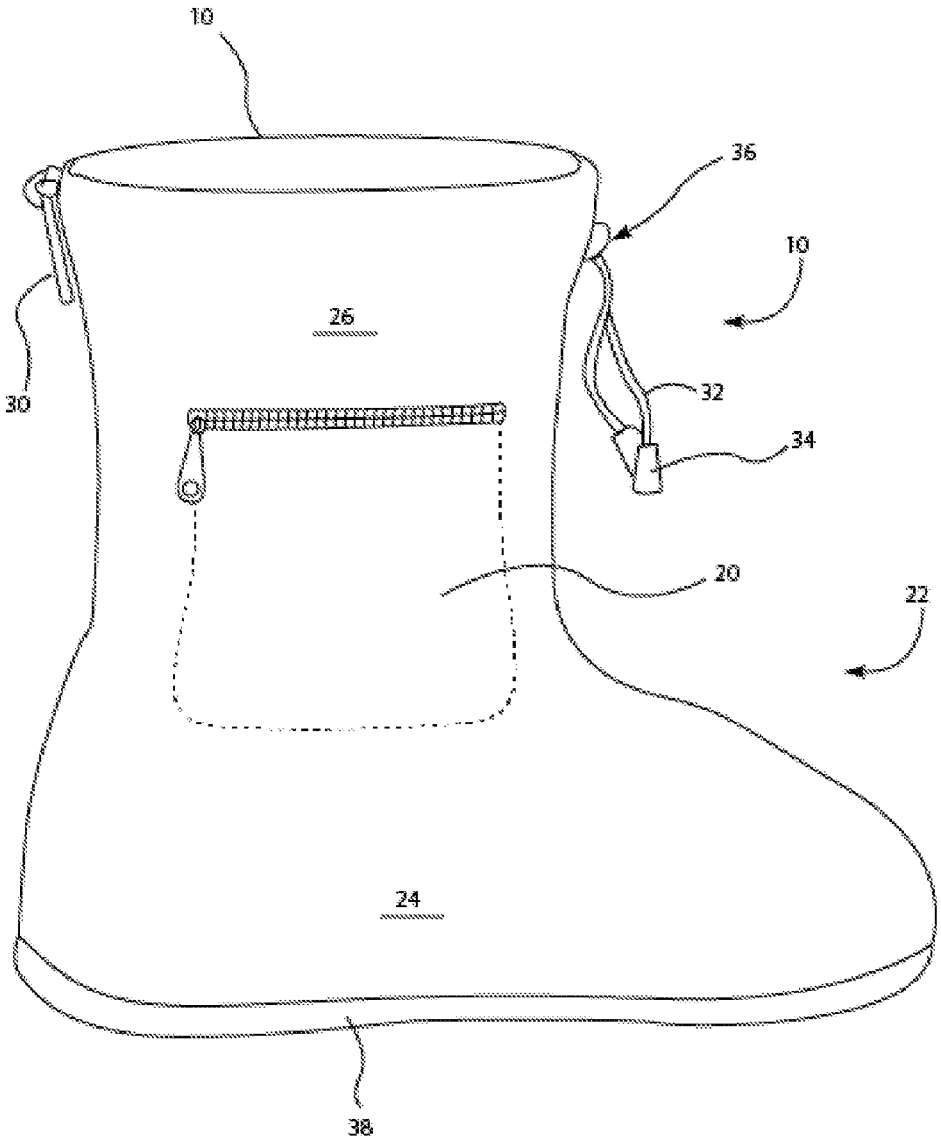
FIG. 1 is a side view.
Figure 2:
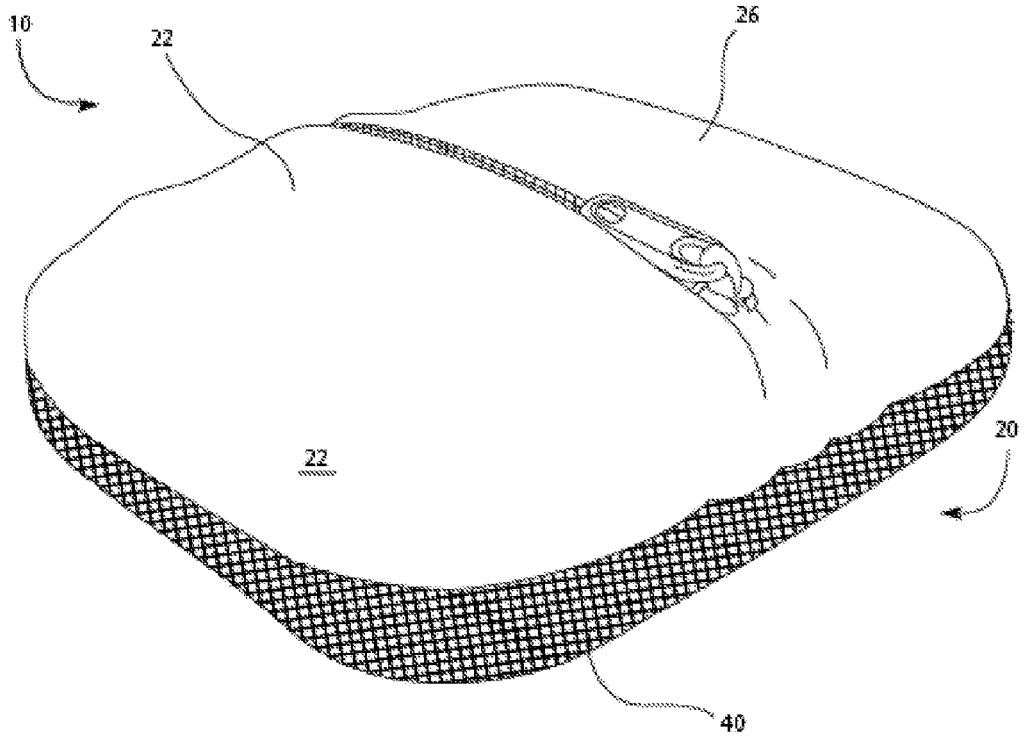
FIG. 2 is an isometric view with an elastomeric sheath disposed in a folded position and stowed within a zippered pocket.
Figure 3:
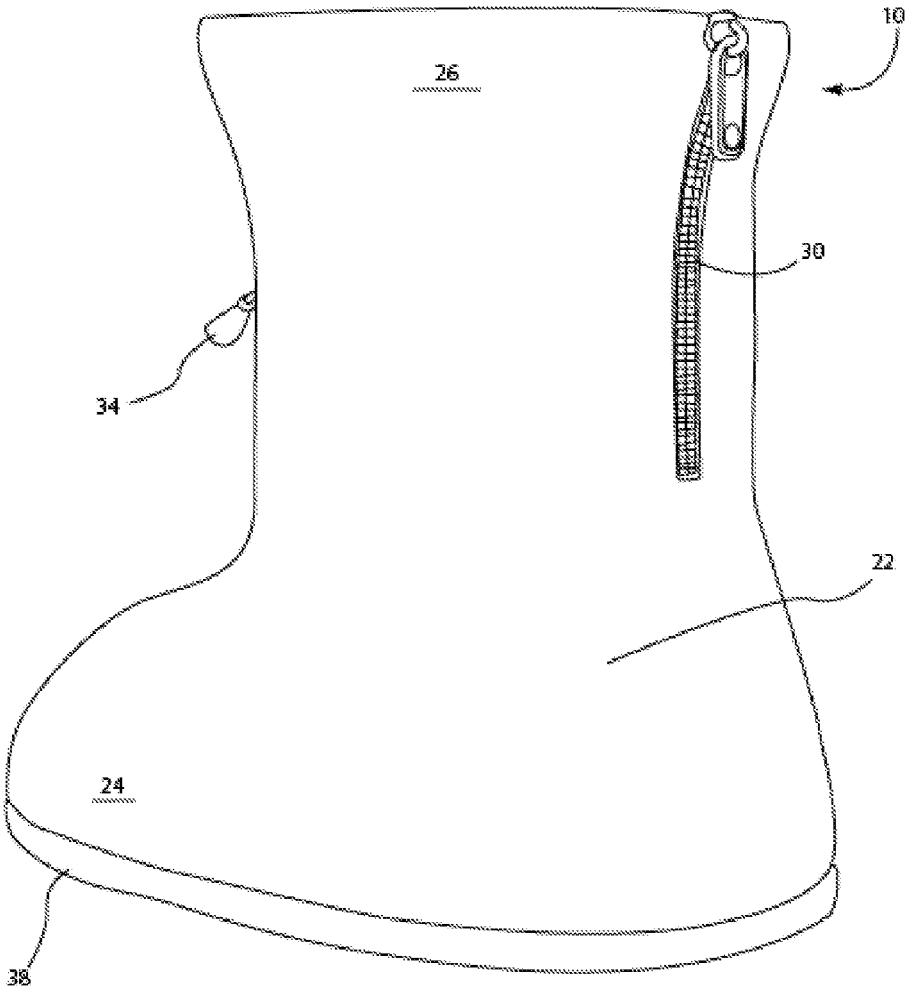
FIG. 3 is an isometric view.
Figure 4:
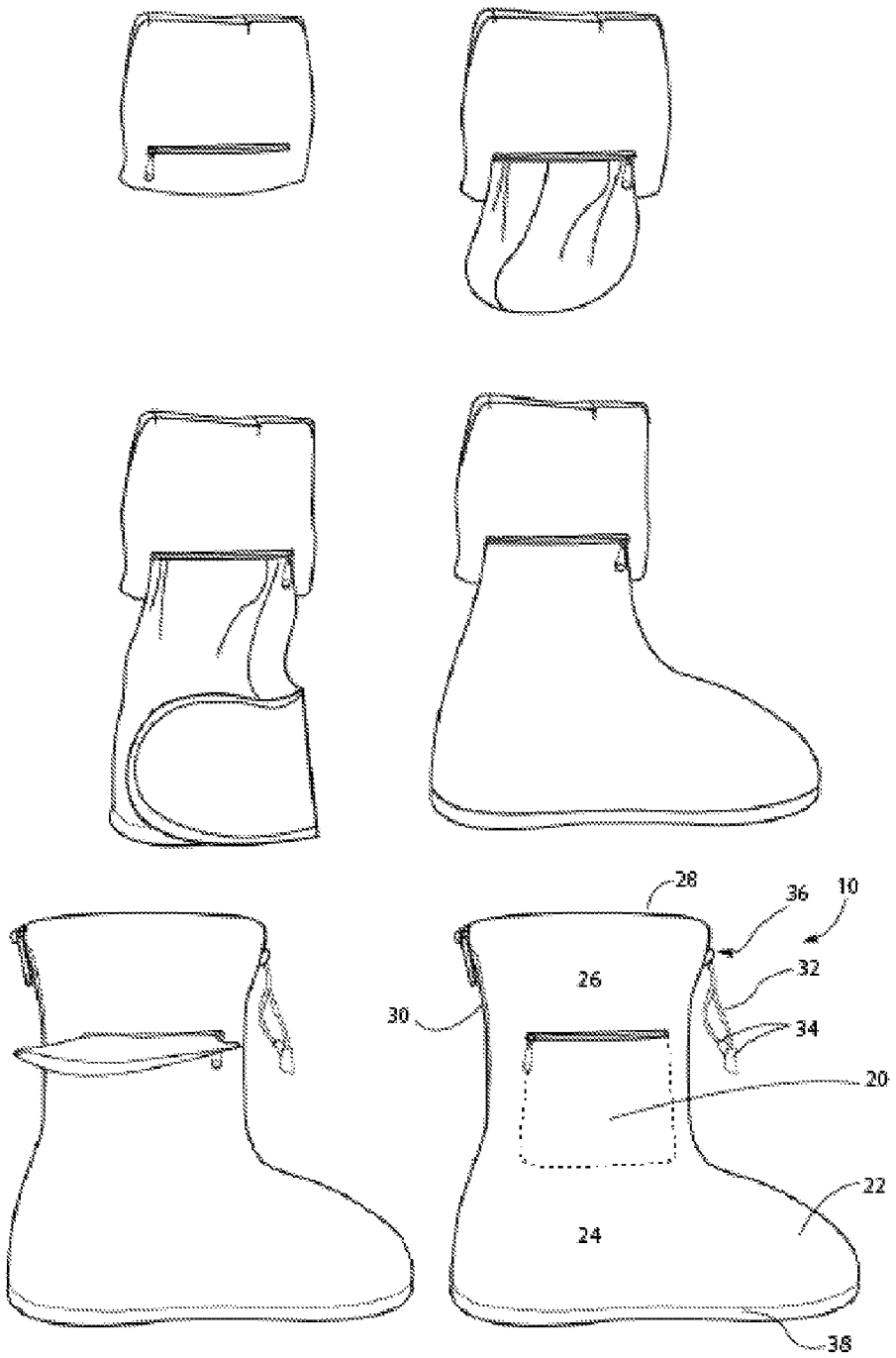
FIG. 4 illustrates folding of the elastomeric sheath to the folded position for storage in the zippered pocket.

With reference now to the drawings, and in particular FIGS. 1 through 4 thereof, example of the instant wearable waterproof shoe cover employing the principles and concepts of the present wearable waterproof shoe cover and generally designated by the reference number 10 will be described.

Referring to FIGS. 1 through 4 a preferred embodiment of the present wearable waterproof shoe cover 10 is illustrated.

The present wearable waterproof shoe cover 10 has been devised to enable a waterproof covering around an extant shoe worn upon the foot, whereby a user may render footwear impermeable to water and other fluids, as desired. The present wearable waterproof shoe cover 10 further folds involuted inside a zippered pocket 20 for storage and portage when not in use.

The wearable waterproof shoe cover 10, therefore includes a pliable, elastomeric sheath 22 disposed to encapsulate an extant shoe disposed upon the foot of a wearer. The elastomeric sheath 22 is conformed to the general shape of a foot and includes a foot portion 24 and an ankle portion 26. The elastomeric sheath 22 is fittable around the foot of a wearer and renders extant footwear impermeable to fluids when needed whereby a user is enabled to walk through wet or muddy terrain, for example, without damaging said extant footwear.

The wearable waterproof shoe cover 10 includes an open top 28 disposed perimetrically around the ankle portion 26. The open top 28 is conformable around a leg of a wearer and enables donning of the sheath 22. For adjustment of the sheath 22 to fit around an extant shoe worn upon the foot, a zipper 30 is disposed posteriorly upon the sheath 22, said zipper 30 disposed in vertical orientation downward from the open top 28. When the zipper 30 is unzipped, the open top 28 may be extended around a greater width than when the zipper 30 is zipped, whereby unzipping the zipper 30 enables positioning of the sheath 22 foot portion 24 around an extant shoe worn upon the foot of a user.

To secure the open top 28 conformable to the leg of a wearer, a drawstring 32 is disposed encircling the open top 28 of the ankle portion 26, said drawstring 32 protruding a pair of ends 34 through an aperture 36 disposed anteriorly upon the sheath 22 in a position overlying the foot portion 24. The pair of ends 34 enables tightening of the drawstring 32 whereby the open top 28 is conformed, and secured, around the leg of a user.

A pliable sole 38 is disposed upon the sheath 22 underlying the foot portion 24. The pliable sole 38 enables tractive engagement against a ground surface when the sheath 22 is worn. The pliable sole 38 therefore contacts the ground when the sheath 22 is worn by a used and increases traction during locomotion.

A zippered pocket 20 is disposed upon the sheath 22 ankle portion 26. The sheath 22 involutes into the pocket 20 when moved to a folded position for storage and portability therein. The sheath 22 is thus foldable and positional interior to the zippered pocket 20, when desired, whereby the sheath 22 is effectively turned inside out and securable within the zippered pocket 20 in a compact and storable situation.

A breathable, elastic mesh fabric inner liner 40 is disposed interiorly upon the sheath 22. The mesh fabric inner liner 40 is disposed to exteriorly surround the sheath 22 when the sheath 22 is involuted into the zippered pocket 20. The mesh fabric liner 40 enables drying of the sheath 22, as needed, whereby mold is preventable and dry footwear afforded even after repeated use of the wearable waterproof shoe cover 10.

In the preferred embodiment herein disclosed, the wearable waterproof shoe cover 10 sheath 22 is comprised of approximately 83% polyester, 15% polyurethane and 2% agglutinant to provide the flexibility required to effect storage into the folded position for involution interior to the zippered pocket 20 while maintaining impermeability.

What is claimed is:

1. A wearable waterproof shoe cover comprising a pliable, durable, elastomeric sheath adapted for fitting around a shoe and ankle of a wearer of said shoe, said sheath having an open top, a zipper disposed posteriorly upon the sheath, said zipper disposed in vertical orientation down from the open top, a pull string disposed to tighten the open top conformable around a wearer's leg, a sole disposed upon a base of the sheath for tractive engagement with the ground, and a zippered pocket disposed upon the side of the sheath, into which zippered pocket the sheath involutes and stows when moved to a folded position securable within the pocket, wherein the wearable waterproof shoe cover is wearable over an extant shoe worn by a wearer and storable in the folded position compactly within the pocket.

2. The wearable waterproof shoe cover of claim 1 wherein the sheath further comprises a breathable, elastic mesh fabric inner layer disposed interiorly upon the sheath, said mesh fabric disposed exteriorly upon the pocket when the sheath is folded and stowed within the pocket.

3. The wearable waterproof shoe cover of claim 2 wherein the sheath comprises 83% polyester, 15% polyurethane and 2% agglutinant.

4. A wearable waterproof shoe cover wearable over a worn shoe, said wearable waterproof shoe cover comprising:

a pliable, elastomeric sheath disposed to encapsulate an extant shoe disposed upon the foot of a wearer;

an open top conformable around a leg of a wearer;

a zipper disposed posteriorly upon the sheath, said zipper disposed in vertical orientation downward from the open top;

a drawstring disposed encircling the open top, said drawstring protruding a pair of ends through an aperture disposed upon the sheath;

a pliable sole disposed upon the sheath for tractive engagement against a ground surface when the sheath is worn;

a zippered pocket disposed upon the sheath into which pocket the sheath involutes when moved to a folded position for storage and portability therein; and a breathable, elastic mesh fabric inner liner disposed interiorly upon the sheath, said mesh fabric inner liner disposed exteriorly around the sheath when the sheath is involuted into the pocket;

wherein the sheath is adjustably fittable over an extant shoe when the zipper is unzipped, said sheath conformable around the leg of a wearer when the zipper is zipped and the drawstring is tightened, whereby the sheath foldably stows involuted interior to the zippered pocket for storage and porting when not in use.

5. The wearable waterproof shoe cover of claim 4 wherein the sheath comprises 83% polyester, 15% polyurethane and 2% agglutinant.

* * * * *